United States Patent [19]

Morrison

[11] Patent Number: 5,017,239

[45] Date of Patent: May 21, 1991

[54] CLEANING VERTICAL WINDOW BLINDS

[76] Inventor: Allan R. Morrison, 481 Simco Street, Winnipeg, Manitoba, Canada, R3G 1W4

[21] Appl. No.: 441,658

[22] Filed: Nov. 27, 1989

[51] Int. Cl.[5] ..... A46B 13/04

[52] U.S. Cl. ..... 134/15; 134/25.1; 134/44; 134/55; 134/83; 15/77; 15/102; 15/210 A

[58] Field of Search ..... 15/308, 210 A, 216, 15/102, 103, 77, 302, 303, 306 R; 134/26, 10, 25.1, 25.4, 29, 39, 31, 40, 37, 129, 137, 9, 117, 187, 188, 195, 15, 43, 55, 44, 83; 68/184, 162

[56] References Cited

U.S. PATENT DOCUMENTS

| | | | |
|---|---|---|---|
| 3,892,004 | 7/1975 | Downes | 15/102 |
| 4,435,874 | 3/1984 | Jacobson | 15/210 A |
| 4,730,360 | 3/1988 | Brügelmann | 15/77 |
| 4,817,646 | 4/1989 | Brooks | 134/29 |

FOREIGN PATENT DOCUMENTS

| | | | |
|---|---|---|---|
| 3716989 | 12/1988 | United Kingdom | 15/210 |

*Primary Examiner*—Anthony McFarlane

*Attorney, Agent, or Firm*—Adrian D. Battison; Stanley G. Ade; Murray E. Thrift

[57] ABSTRACT

A cleaning process is provided for window blinds of the type comprising vertical strips of fabric which are supported at an upper end so as to lie in parallel planes which are rotatable. The process includes a carrying frame for attachment to the lower end of the strips by which the strips are maintained in their proper parallel condition during detachment, washing, rinsing, drying and reattachment. After detachment the strips are immersed in a bath of cleaning liquid which flows longitudinally of the strips from the carrying frame to trailing end of the strips. Rinsing is carried in a similar bath. Drying is carried out by passing the strips between parallel runs of an absorbent fabric.

19 Claims, 4 Drawing Sheets

CLEANING VERTICAL WINDOW BLINDS

This invention relates to the method and apparatus for cleaning vertical window blinds of the type which include a plurality of strips of a flexible fabric material which are supported at upper ends thereof in parallel spaced relation so as to hang from the upper support system to weighted and constrained lower ends. This type of blind has become increasingly popular in recent years in that it provides an attractive and convenient arrangement which can be rotated so that the strips lie at right angles to the window to allow light to enter or to lie parallel to the window to close off the light.

While blinds of this type duly remain cleaner than conventional curtains because they are less attractive to dust, eventually over time they become increasingly soiled. There is therefore a significant problem in cleaning blinds of this type on an economic basis in view of the difficulty of disassembling the blinds, cleaning the individual long strips and returning the blinds to the initial position. In addition if washed together in an unsupported manner the strips simply become entangled and creased and are effectively no longer usable.

Attempts have been made to clean the blinds singly in situ using a dry cleaning fluid but this is generally slow, very labor intensive and the quality of cleaning is very variable.

It is one object of the present invention, therefore, to provide an improved method and apparatus for cleaning window blinds of this type.

According to the invention, therefore, there is provided a method of cleaning vertical blinds of the type comprising a plurality of strips of a flexible fabric material and a support system including an upper support means for supporting strips such that they hang in parallel vertical arrangement, the method comprising attaching a plurality of the strips to a carrying frame separate from the support system, removing the attached strips from the upper support means, transporting the strips carried on the carrying frame from the support system to a cleaning bath containing a cleaning liquid, inserting the strips and the carrying frame into the bath and causing the liquid to flow in a direction from the carrying frame longitudinally of the strips to cause a cleaning action on the strips while the strips are supported by the carrying frame.

According to a second aspect of the invention there is provided an apparatus for cleaning vertical blinds of the type comprising a plurality of strips of a flexible fabric material and a support system including an upper support means for supporting strips such that they hang in parallel vertical arrangement, the apparatus comprising a carrying frame arranged for attachment to a plurality of the strips including a plurality of projecting engagement member such that each strip has a lower end thereof mounted on a respective one of said engagement member and a cleaning bath for containing a cleaning liquid and having an elongate channel into which the strips can be inserted, means for supporting the carrying frame at one end of the channel and means for causing the liquid to flow in a direction from the carrying frame longitudinally of the strips of cause a cleaning action on the strips while the strips are supported by the carrying frame.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
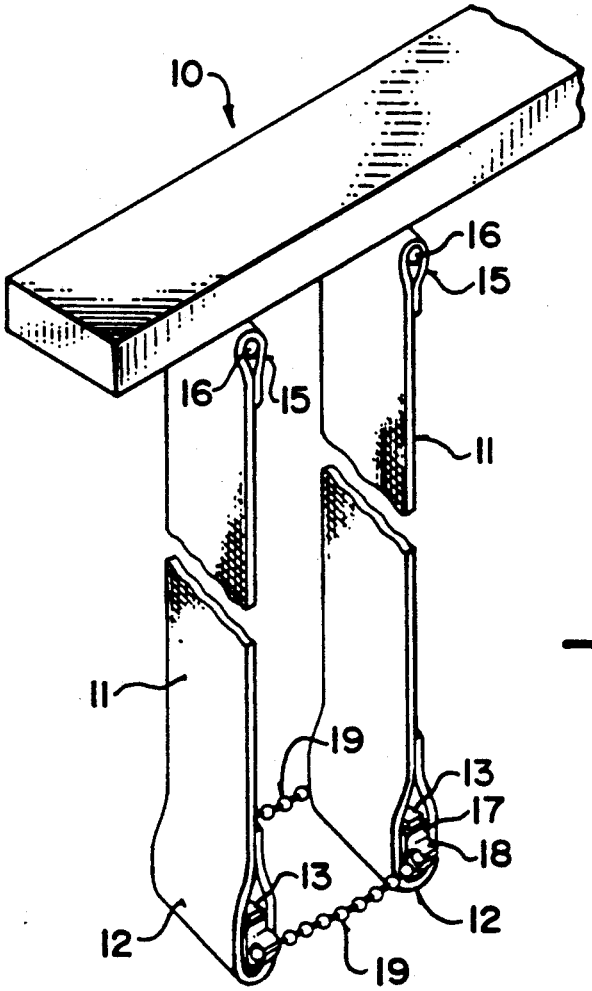
FIG. 1 is an isometric view of a window blind arrangement of the type with which the present invention is concerned.

A conventional window blind is shown in FIG. 1 and includes a header support 10 and a plurality of flexible fabric strips 11 which are suspended from the header support 10. The strips are formed of a generally stiffened fabric material which has a loop 12 at the lower end receiving a weight 13 in the form of a metal bar so as to tend to hold the fabric strips in a vertical plane. The upper end of the fabric strips also includes a loop 15 into which is inserted a carrying bar 16 attached to the header support 10. The carrying bar can be rotated about a vertical axis so that the fabric strip also rotates about that axis from a position generally at right angles to the associated window or wall to a position in which the blind is attached to a position lying parallel to the window. The header support is arranged to rotate all of the strips simultaneously s that they remain lying in parallel planes as they rotate. The metal bars 13 are attached to a plastic spring clip arrangement 17 which includes a U-shaped loop 18 connected to a lightweight connector chain 19. Thus the lower end of each of the strips is attached to the next adjacent strip. The chains 19 extend from both the front and rear ends of the bar 13 so that the front and rear edges of the strips are attached to the next adjacent strips. This tends to hold the strips in the proper parallel vertical planes and to ensure that the lower ends also move simultaneously in the rotational action from the closed to the open positions and vice versa.

A cleaning system for these blinds is shown in FIGS. 2 through 7. The basic part of the cleaning system comprises a carrying frame 20 by which the fabric strips can be grasped and transported through the various steps of the cleaning process. The carrying frame comprises a base frame 21 forwardly from which projects a plurality of blade members 22 which lie in parallel planes spaced across the width of the base frame 21. The blade members 22 are formed from wire loop so that each blade member comprises a pair of horizontal parallel wire bars 23 and 24 interconnected at the outer end remote from the base frame 21 by a vertical connecting bar 25.

Figure 2:
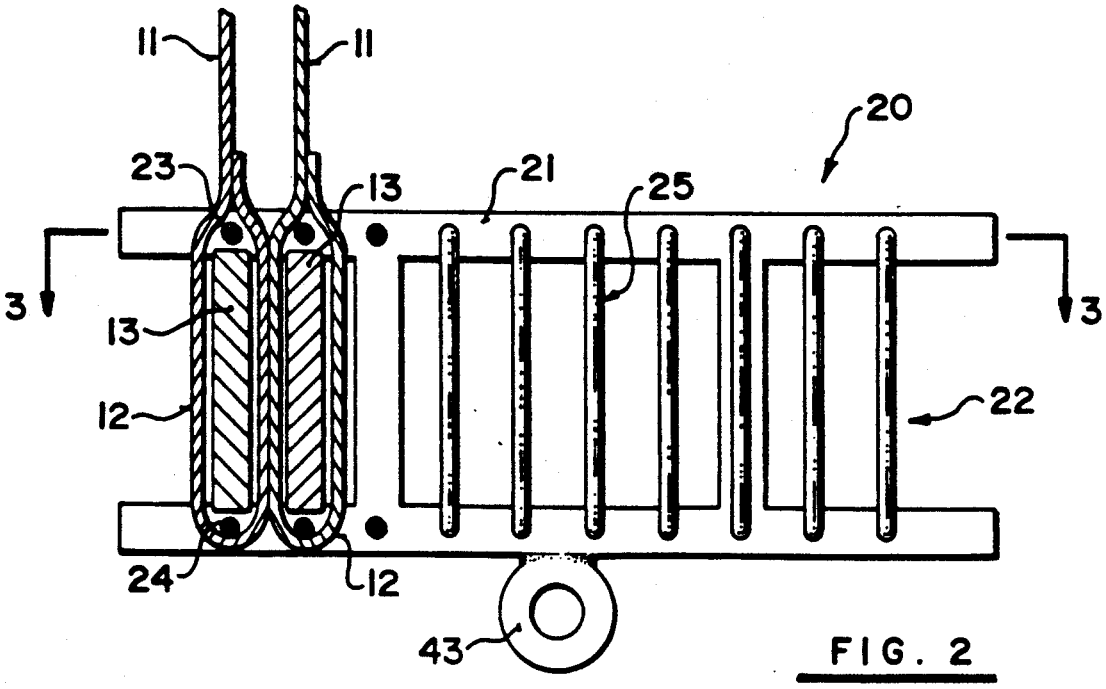
FIG. 2 is a cross-sectional view of a lower end of the blind of FIG. 1 on an enlarged scale showing the blind attached to a carrying frame, the cross-section being taken along the lines 2—2 of FIG. 3.
Figure 3:
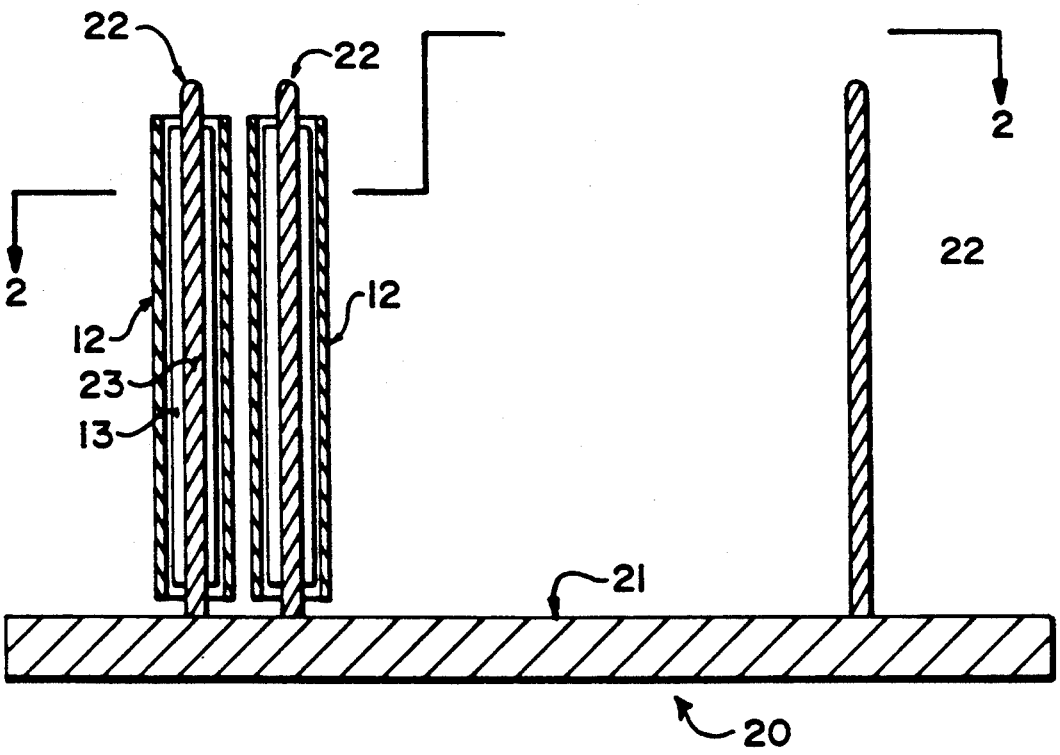
FIG. 3 is a cross-sectional view along lines 3—3 of FIG. 2.

The blade members are dimensioned so they can be inserted into the loop at the lower end of each of the fabric strips along side the metal bar 13. As shown in FIG. 2, the blade member has been inserted into the fabric loop 12 at the lower end of the strip 11 with the vertical bar 25 passing along one side of the metal weight 13 until it reaches the other end of the metal weight 13 where it engages around the other end of the metal weight 13 allowing the horizontal wire bars 23 and 24 to slip above and below or alongside the metal weight as shown in FIG. 2.

The spacing between the blade members 22 is just sufficient to receive each of the fabric loops and associated metal weights so that it is necessary when inserting the fabric strips onto the respective blade members to draw the fabric strips together at the lower end. The metal weights remain in place within the respective loop and the chains are drawn together so they merely hang down underneath or along side the respective blade member.

With the lower ends of the strips thus firmly attached and supported by the carrying frame 20, the upper ends of the strips can be disconnected from the header support 10. The strips can then be held manually at the upper end while the support 20 is moved upwardly to lift the strips they are carried in a manner trailing from the carrying frame 20.

The strips are thus maintained in a proper parallel position overlying one another without any possibility of twisting or becoming entangled.

Figure 4:
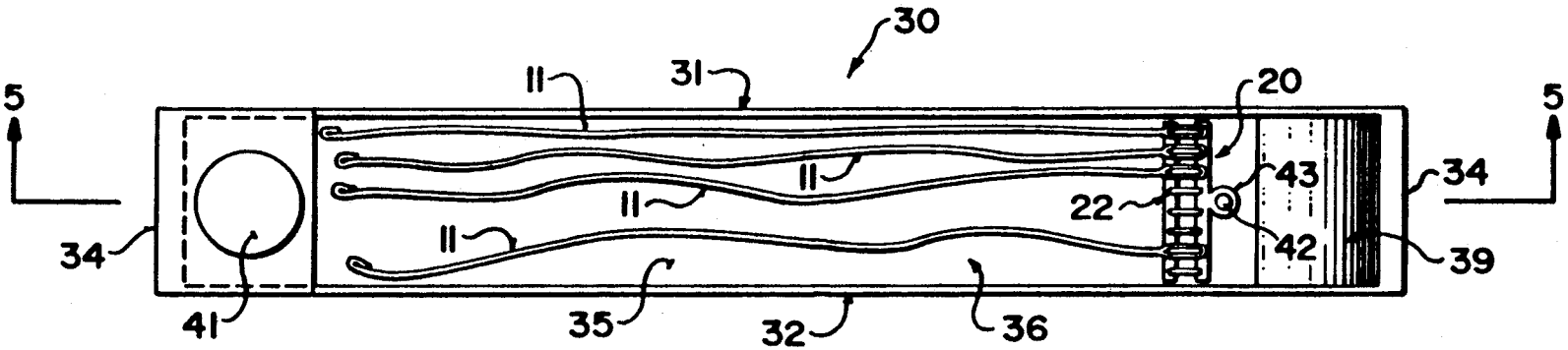
FIG. 4 is a top plan view of a bath for the blind of FIG. 1.
Figure 5:
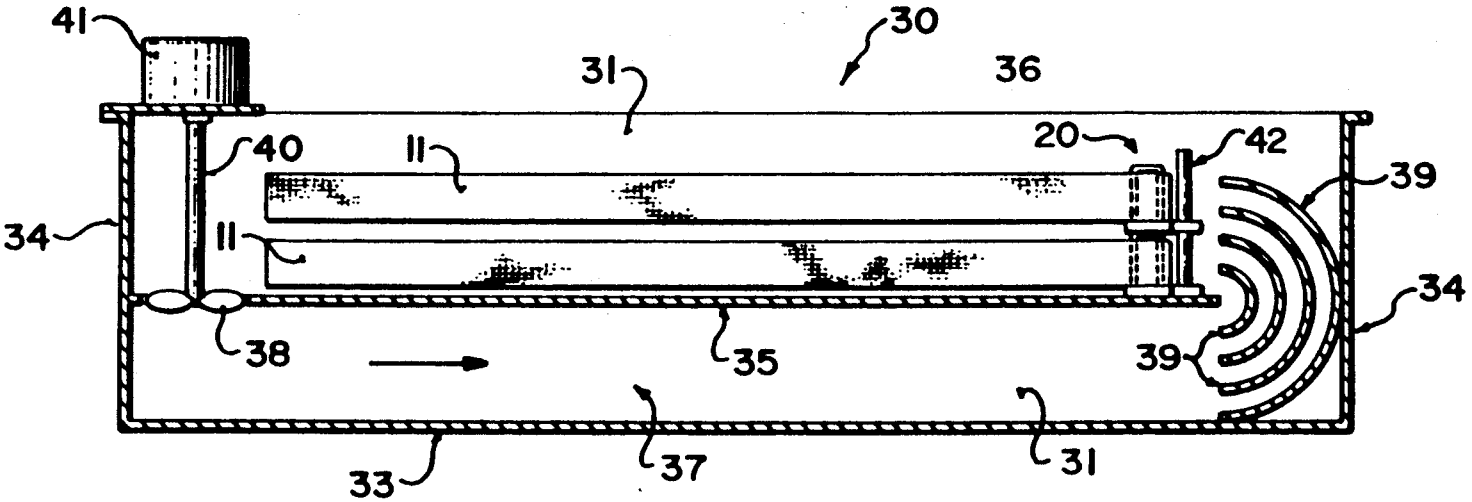
FIG. 5 is a cross-sectional view along lines 5—5 of FIG. 4.

The carrying frame 20 and the strips are then carried to the bath shown in FIGS. 4 and 5 and indicated generally at 30. The bath is an elongate horizontal bath defined by side walls 31 and 32 and a bottom wall 33. Ends of the bath are indicated at 34 and 35 thus defining a rectangular container of a width slightly greater than the carrying frame 20 and a length of the order of 8–10 feet which is sufficient to receive the length of the vast majority of strips of conventional blinds of this type.

The bath is divided by a horizontal wall 35A into an upper chamber 36 and a lower chamber 37. A propeller 38 is mounted in the dividing wall 35 so as to project or propel a cleaning liquid in the upper chamber 36 downwardly into the lower chamber 37 so that it flows in a return path along the lower chamber 37 to an inlet end of the upper chamber 36. A plurality of semicircular guide walls 39 are provided at the inlet end of the upper chamber 36 so as to redirect the liquid as it turns from the return chamber 37 into the feed end of the upper chamber 36 to maintain a substantially linear flow of the cleaning liquid. The propeller 38 is mounted upon a shaft 40 driven by a motor 41. The shaft is arranged in vertical direction with the propeller in a horizontal plane since this is convenient for the mounting of the motor and the support of the shaft 40.

At the feed end of the upper chamber 36 is mounted a vertical post 42. The vertical post engages a loop 43 on a rear face of the carrying frame 20 so that with the loop engaged over the vertical shaft, the blade members 22 stand upwardly lying in a plane longitudinal of the bath 36. This allows the strips 11 to be inserted into the bath so that they trail along the length of the bath supported by the carrying frame 20. With the liquid flowing longitudinally of the bath 36, the strips 11 are maintained in a longitudinal condition lying along the length of the bath and they are held firmly at the upstream end by the carrying frame 20 thus preventing sufficient twisting to allow the strips to become entangled or creased. However the flow of the liquid longitudinally of the strips allows the strips to flutter to some extent causing a cleaning action from side to side of the strips. Cleaning fluid turbulence also assists in cleaning.

As shown in FIG. 5, the bath can have a sufficient depth to accommodate two such carrying frames 20 and associated strips 11. With one of the carrying frames 20 being mounted on top of the other both being carried by the shaft 42 from the respective loop 43. The depth of the bath is sufficient to accommodate flow of the liquid along the return channel 37 which is free from voids or air in flow through the propeller 38 so that the liquid moves continually without bubbles.

After the cleaning action within the bath 30 is complete, the trailing ends of the strips can be grasped manually and a slight tension applied to the strips so that they can be lifted out from the bath while maintaining straight parallel condition support of the forward end by the carrying frame 20. The strips and the carrying frame can then be transferred to a second bath identical to the first bath and filled with a rinsing liquid, for example clean water. When fully rinsed, the strips can again be grasped and lifted from the second bath in a cleaned but wet condition.

Figure 6:
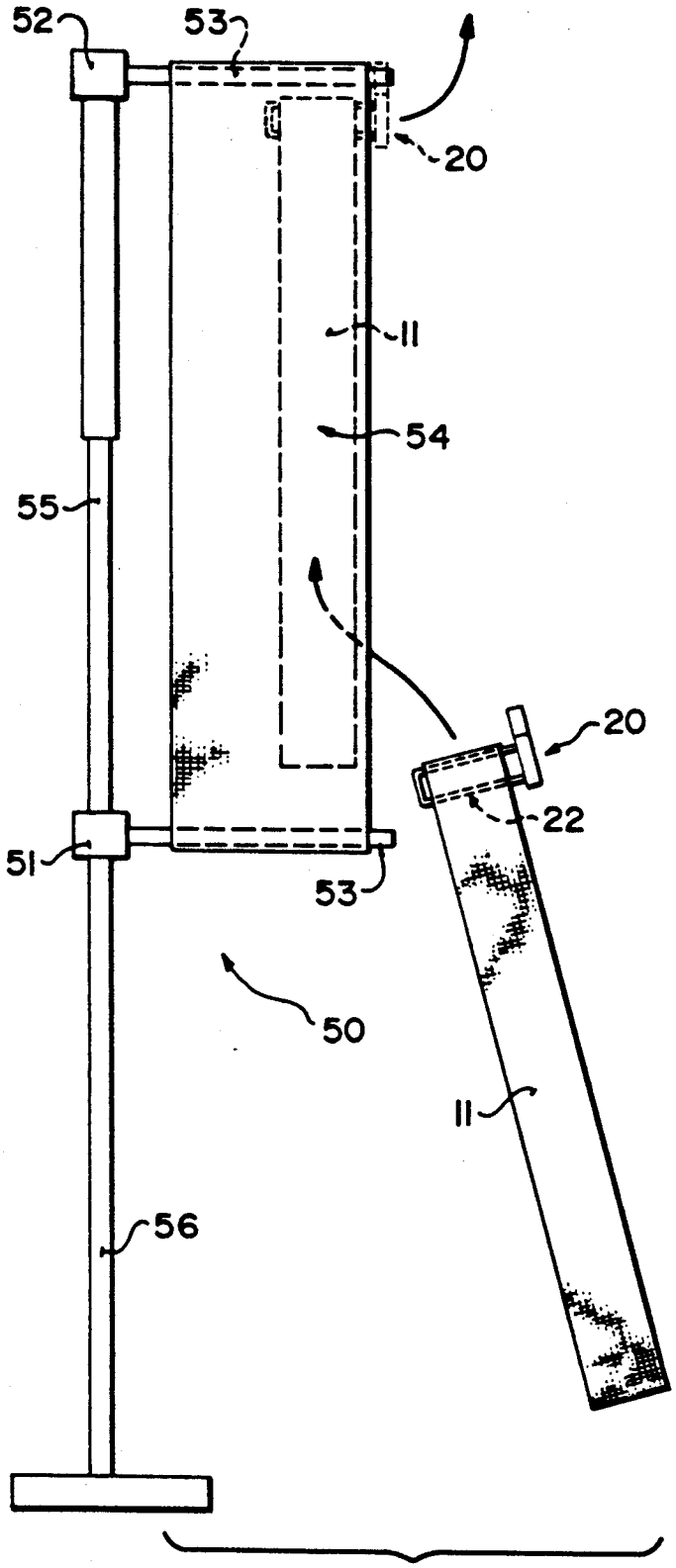
FIG. 6 is a side elevational view of a drying arrangement for the blind of FIG. 1.
Figure 7:
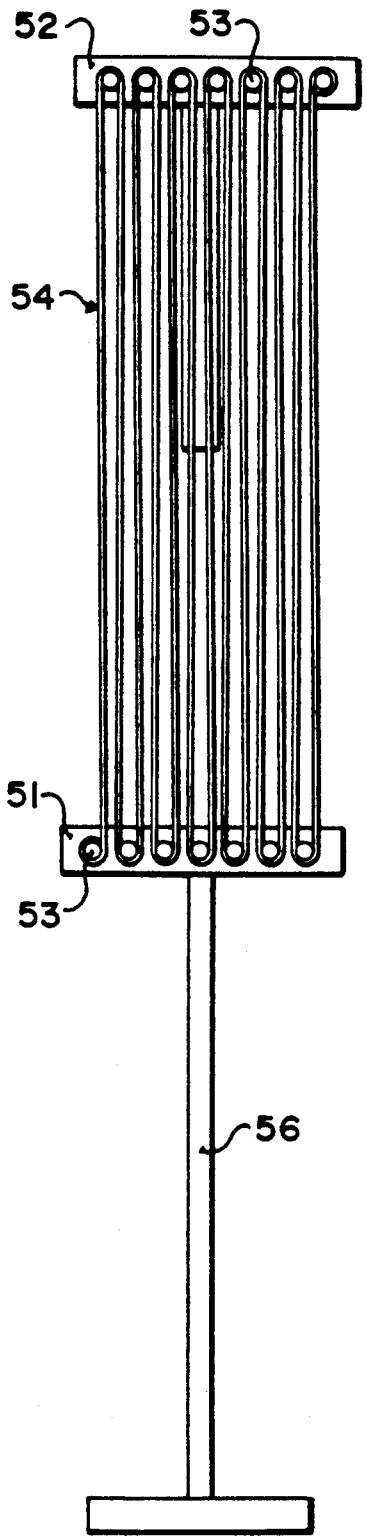
FIG. 7 is a front elevational view of the drying device of FIG. 6.

The drying action is shown in FIGS. 6 and 7 and it provided by a drying assembly generally indicated at 50. The drying assembly comprises a lower support member 51 and an upper support member 52. Each of these support members includes a plurality of forwardly extending fingers 53 around which is wrapped a continuous length of a toweling or other similar absorbent fabric material 54. In this way a plurality of parallel runs of the fabric material are formed. The upper support member 52 is supported relative to the lower support member 51 by an elongate strut 55 which is formed in two parts so as to allow longitudinal adjustment of the spacing between the upper and lower support members. The lower support member is supported on a suitable frame work 56 so that the parallel runs of the toweling fabric are carried in a vertical orientation spaced from the ground. The carrying frame 20 and the trailing strips 11 are then brought up to the lower end of the drying assembly and the blade members 22 inserted between the parallel runs of the toweling fabric. The trailing strips are then brought into position s they lie inside the parallel runs of the toweling fabric. The support 20 is then brought to rest at the top of the drying assembly with the strips hanging downwardly between the parallel runs of the fabric. A compressing action against the sides of the drying assembly then touches the toweling fabric against the sides of the strips 11 so as to withdraw the moisture carried on the strips 11 into the toweling fabric. The support member 20 in addition shown in phantom line in the drying location can then be drawn out from the top of the drying assembly with the strips remaining attached thereto. In order to insert the strips and the support member 20 into the drying assembly, it may be necessary to disconnect the chains on the side of the blade members adjacent the drying assembly. After the unit is removed, the chains can be reconnected. The toweling fabric can be dried by reducing the distance between the supports 51 and 52 and wringing out the excess moisture.

The strips while still attached to the carrying frame 20 are thus fully cleaned and dried and in condition to be replaced upon the header support 10. This is carried out by manually grasping the trailing ends of the strips and returning them to the upper position with the carrying frame hanging downwardly. The upper end of the strips can then be reattached to the head support 10.

The strips are thus fully cleaned and dried and replaced while they remain supported by the carrying frame 20 so that they prevent it from becoming entangled, twisted or creased. In this way no disentanglement is necessary and the strips retain their stiffened condition which is necessary for an acceptable appearance of the blinds when attached to the window area.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of cleaning vertical blinds comprising a plurality of strips of a flexible fabric material and a support system including an upper support means for supporting strips such that they hang in parallel vertical arrangement, the method comprising attaching a plurality of the strips to a carrying frame separate from the support system, removing the attached strips from the upper support means, transporting the strips carried on the carrying frame from the support system to a cleaning bath containing a cleaning liquid, inserting the strips and the carrying frame into the bath and causing the liquid to flow in a direction from the carrying frame longitudinally of the strips to cause a cleaning action on the strips while the strips are supported by the carrying frame.

2. The method according to claim 1 wherein the carrying frame is arranged to engage the strips only at one position along the length thereof with the strips being free from support along the remainder of the strips such that the liquid is free to flow over the strips with the strips being free to move within the liquid.

3. The method according to claim 2 wherein the carrying frame grasps the strips at the lower end thereof.

4. The method according to claim 1 including rinsing the strips in a second bath, drying the strips and replacing the strips on the support system while the strips remain attached to the carrying frame.

5. The method according to claim 1 wherein the carrying frame includes a plurality of blade members each for receiving a loop of a respective one of the strips wrapped around the blade member, the loop being formed at a lower end of the strip remote from the upper support means.

6. The method according to claim 5 wherein the loop includes a weight for stretching the strip when suspended from the upper support means, the weight being retained within the loop while the loop is received upon the blade member.

7. The method according to claim 6 wherein each strip includes chain means for connection to the next adjacent strip and wherein the chain remains connected when the strip is attached to the carrying frame.

8. The method according to claim 1 wherein the strip is supported only at the lower end so that the remainder of the strip is loose within the bath.

9. The method according to claim 1 wherein the bath includes a horizontal channel, the carrying frame being mounted at one end of the horizontal channel with the strips extending longitudinal of the horizontal channel, the liquid being caused to flow along the length of the horizontal channel.

10. The method according to claim 9 wherein the bath includes a return path and a propeller for generating flow of the liquid along the horizontal channel and the return path, the propeller having a transverse area which is a majority of the area of the return path.

11. The method according to claim 1 including the step of drying the strips while attached to the carrying frame by passing the carrying frame and the strips between parallel bands of an absorbent fabric material.

12. The method according to claim 11 wherein the bands are supported only at ends thereof under sufficient tension to hold the bands parallel and wherein the bands are compressed so as to engage the side of the strips so as to extract moisture from the strips.

13. The method according to claim 12 including releasing the support of the bands and rotating the bands to wring out excess moisture.

14. Apparatus for cleaning vertical blinds comprising a plurality of strips of a flexible fabric material and a support system including an upper support means for supporting strips such that they hang in parallel vertical arrangement, the apparatus comprising a carrying frame arranged for attachment to a plurality of the strips including a plurality of projecting engagement member such that each strip has a lower end thereof mounted on a respective one of said engagement member and a cleaning bath arranged to contain a cleaning liquid and having an elongated channel arranged to receive the strips such that said strips extend longitudinally of the channel, means for supporting the carrying frame at one end of the channel and means for causing the liquid to flow in a direction from the carrying frame longitudinally of the strips to cause a cleaning action on the strips while the strips are supported by the carrying frame.

15. The apparatus according to claim 14 wherein the carrying frame includes a plurality of blade members each for receiving a loop of a respective one of the strips wrapped around the blade member.

16. The apparatus according to claim 14 wherein the bath includes a return path and a propeller for generating flow of the liquid along the horizontal channel and the return path, the propeller having a transverse area which is a majority of the area of the return path.

17. Apparatus for cleaning and drying vertical blinds comprising a plurality of strips of a flexible fabric material and a support system including an upper support means for supporting strips such that they hang in parallel vertical arrangement, the apparatus comprising a carrying frame arranged for attachment to a plurality of the strips including a plurality of projecting engagement member such that each strip has a lower end thereof mounted on a respective one of said engagement member and a cleaning bath arranged to contain a cleaning liquid and having an elongated channel arranged to receive the strips such that said strips extend longitudinally of the channel, means for supporting the carrying frame at one end of the channel and means for causing the liquid to flow in a direction from the carrying frame longitudinally of the strips to cause a cleaning action on the strips while the strips are supported by the carrying frame, and including a drying arrangement for drying the strips while attached to the carrying frame, the drying arrangement including a plurality of parallel bands of an absorbent fabric material.

18. The apparatus according to claim 17 wherein the bands are supported only at ends thereof under sufficient tension to hold the bands parallel.

19. A method of cleaning vertical blinds comprising a plurality of strips of a flexible fabric material and a support system including an upper support means for supporting strips such that they hang in parallel vertical arrangement, the method comprising attaching a plurality of the strips to a carrying frame separate from the support system, removing the attached strips from the upper support means, transporting the strips carried on the carrying frame from the support system to a cleaning bath containing a cleaning liquid, inserting the strips and the carrying frame into the bath and causing the liquid to flow in a direction from the carrying frame longitudinally of the strips to cause a cleaning action on the strips while the strips are supported by the carrying frame, the carrying frame including a plurality of blade members each for receiving a loop of a respective one of the strips wrapped around the blade member, the loop being formed at a lower end of the strip remote from the upper support means, and drying the strips while attached to the carrying frame by passing the carrying frame and the strips between parallel bands of an absorbent fabric material.

* * * * *